United States Patent [19]

Itoh

[11] 4,029,995

[45] June 14, 1977

[54] APPARATUS FOR PRODUCING CHARGED PARTICLES

[75] Inventor: Tsutomu Itoh, Tokyo, Japan

[73] Assignee: Onoda Cement Company, Ltd., Japan

[22] Filed: Jan. 6, 1976

[21] Appl. No.: 646,942

[52] U.S. Cl. ..... 361/226

[51] Int. Cl.[2] ..... H05B 5/02

[58] Field of Search ..... 317/3, 4, 262 R, 262 A

[56] References Cited

UNITED STATES PATENTS

| | | | |
|---|---|---|---|
| 3,872,361 | 3/1975 | Masuda | 317/3 X |

FOREIGN PATENTS OR APPLICATIONS

| | | | |
|---|---|---|---|
| 1,052,820 | 1/1954 | France | 317/4 |
| 1,027,113 | 3/1958 | Germany | 317/3 |

*Primary Examiner*—Harry E. Moose, Jr.

*Attorney, Agent, or Firm*—Price, Heneveld, Huizenga & Cooper

[57] ABSTRACT

In a pair of surface-shaped silent discharge electrodes opposed to each other and separated by a predetermined space therebetween, phases of alternating voltages are applied to said respective silent discharge electrodes shifted in phase with respect to each other so that a silent discharge may arise alternately on either one of the electrode surfaces. A second alternating voltage is applied between the silent discharge electrodes and is alternatingly varied at a fundamented frequency twice as high as the frequency of the first alternating voltages applied to said surface-shaped silent discharge electrodes and is not inverted in polarity during the period when the silent discharge exists on either one of the electrode surfaces. Powder particles are passed through the space which separates the pair of surface-shaped silent discharge electrodes and charged in either positive or negative polarity continuously at a high efficiency.

11 Claims, 8 Drawing Figures

Figure 1:
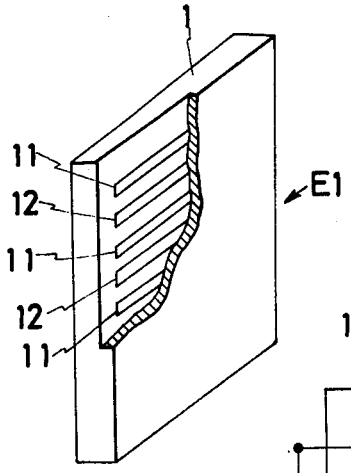

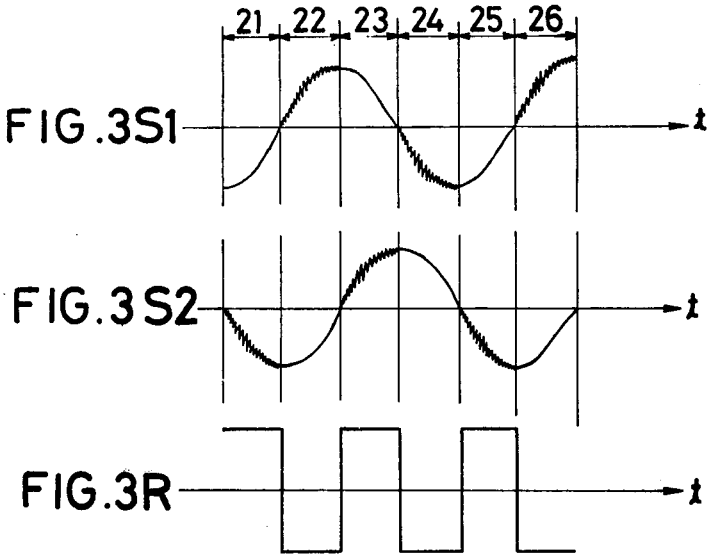
FIG.4
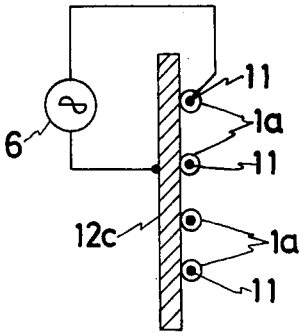
FIG.5
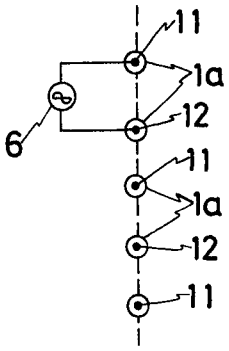
FIG.6
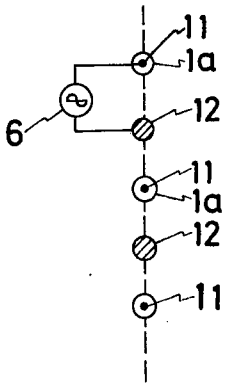

APPARATUS FOR PRODUCING CHARGED PARTICLES

The present invention relates to apparatus for producing charged particles to obtain a large amount of solid or liquid fine particles having monopolar electric charge, which apparatus is useful in apparatus for electro-mechanically controlling powders such as an electric dust collecting apparatus, powder conveying apparatus, electrostatic powder painting apparatus, and electrostatic hair-planting apparatus.

With regard to methods for charging powder particles in a single polarity, there is known in the prior art a method of utilizing contact charging or friction charging, a method for obtaining monopolarly charged powder particles in which a D.C. high voltage is applied between an acicular, linear of knife edge-like electrode and a planar, cylindrical or spherical electrode opposed to the former electrode to generate corona discharge. Ions produced by this corona discharge are made to collide against and adhere to the powder particles. Also known is a particle charging apparatus characterized in that said apparatus comprises alternating electrodes having planar or any arbitrary shape of electrode surfaces for establishing an alternating electric field. These electrodes are insulated from each other and disposed in parallel to each other spaced apart a predetermined distance. One or more third electrodes for discharging are disposed repsectively at the centers of one or more small holes or slits provided in each said alternating electrode and insulated from said alternating electrode. An A.C. voltage supply is provided for applying an alternating voltage between said alternating electrodes, and a D.C. or A.C. voltage supply is provided for applying a D.C. or A.C. voltage between said third electrodes and said alternating electrodes.

Reviewing these prior art methods, the method of utilizing contact charging has a great disadvantage in that the quantity of charge given to a powder is hardly determined definitely and accordingly control of the quantity of charge is difficult. Nextly, the method of utilizing corona discharge has a great disadvantage in that although there exists a definite quantative relation that a saturated quantity of charge acquired by a powder particle is proportional to a square of a particle diameter and an electric field strength in the charging region, the charged particles are driven by a Coulomb's force directed from the corona discharge electrode to the opposite electrode resulting in adherence of particles having a large quantity of charge onto the opposite electrode. Thus it is impossible to extract the best charged particles into a desired space. Apparatus in which ions generated by spark discharge within a hole provided on the opposite surface are extracted by an A.C. voltage applied between the opposed electrodes into a space which separates the opposed electrodes, has a great disadvantage in that utilization efficiency of electric power is extremely poor. This results because the discharge arising between the thin hole and the discharge electrode is a spark discharge, and that in the space through which the particles pass, always a flow of the powder would occur accompanying the pass of the particles and the thus dispersed powder particles adhere onto the entire surface of the electrode. The powder especially adheres to the neighborhood of the thin hole and the tip of the discharge electrode, resulting in a remarkable rise of the discharge voltage, so that it is difficult to operate the apparatus continuously over a long period of time. In addition, in the above referred apparatus it is definitely impossible to achieve charging of conductive powders because there exists no insulator between the thin hole and the discharge electrode.

It is one object of the present invention to provide an apparatus for producing charged particles, which is free from all the disadvantages of the heretofore existing particle charging apparatus as referred to above, which can produce a large amount of solid or liquid fine particles of high density having a monopolar electric charge and can supply these charged fine particles correctly to a desired region at a high rate, and in which the above-described operation can be conducted at a very high efficiency.

According to one feature of the present invention, there is provided an apparatus for producing charged particles, comprising a pair of surface-shaped ion generating electrodes, in each of which every other one of parallel linear electrodes are spaced apart at a predetermined interval are connected in common to form separate electrode groups. The parallel linear electrodes other than one said electrode group being coated with an insulator, and an alternating voltage is applied between said respective electrode group. In one embodiment a pair of surface-shaped ion generating electrodes in each of which there are provided a grid electrode consisting of parallel linear electrodes spaced apart at a predetermined interval and a surface-shaped electrode spaced apart from said grid electrode at a substantially fixed distance and insulated by an insulator. In each embodiment an alternating voltage is applied between said respective electrodes; a charging space is formed between said pair of ion generating electrodes which are opposed to each other; means are provided for shifting the phases of the alternating voltages applied to the respective ion generating electrodes relative to each other and a voltage supply means is provided for applying between said respective ion generating electrodes another alternating voltage having a fundamental frequency twice as high as the frequency of the alternating voltage applied to the respective ion generating electrodes in such phase relationship to said latter alternating voltage that the inversion of the relative voltage between said respective electrode surfaces may not occur during the period when silent discharge is arising on one of the electrode surfaces.

Figure 2:
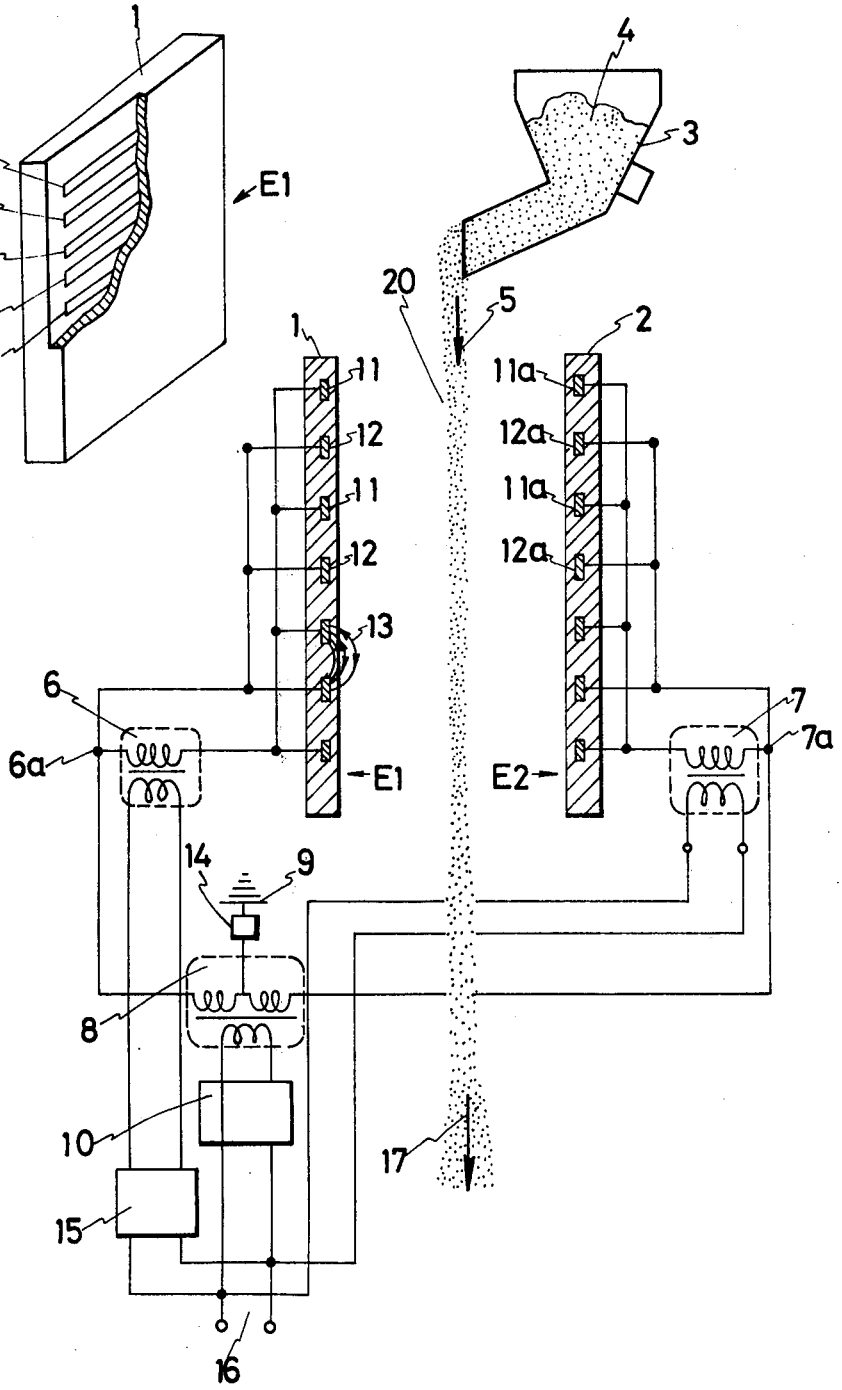
Figure 7:
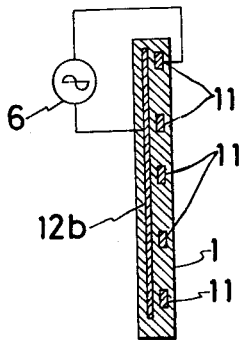
Figure 8:
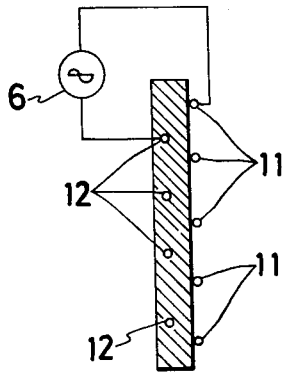
Figure 9:
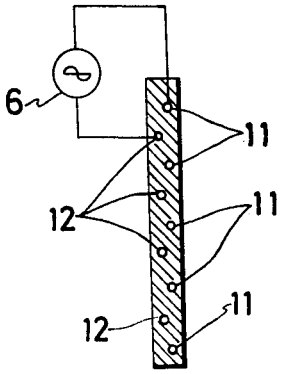
Figure 10:
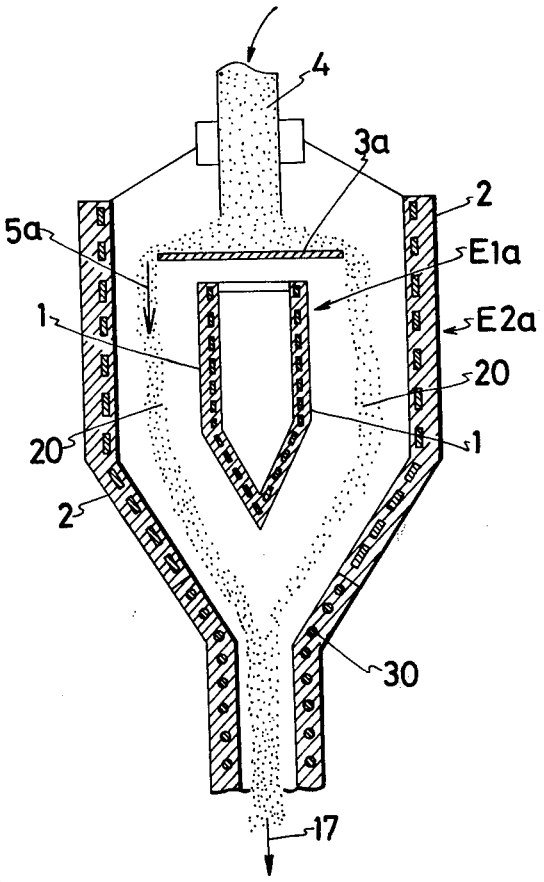

These and other objects and features of the present invention will be better understood by reference to the following description of its preferred embodiments taken in conjunction with the accompanying drawings, in which:

FIG. 1 is a perspective view partly cut away of a part of the apparatus for producing charged particles according to the present invention, that is, of a surface-shaped silent discharge electrode of the same apparatus, FIG. 2 is an electric circuit diagram of the same apparatus for producing charged particles, FIGS. $3S_1$, $3S_2$ and 3R are voltage waveform diagrams at predetermined points in FIG. 2, FIGS. 4, 5, 6, 7, 8 and 9 are schematic views of the parts corresponding to the parts shown in FIG. 1 in modified embodiments of the present invention, and FIG. 10 is a logitudinal cross-section view of a part of a modified embodiment which corresponds to a part of the embodiment illustrated in FIG. 2.

Referring now to FIG. 1 of the drawings, in the surface-shaped silent discharge electrode employed according to the present invention, there exist parallel linear electrodes 11 and 12 embedded in a shallow portion of an insulator layer along its surface. Every other one of these parallel linear electrodes are connected in common to form separate groups as shown in cross-section in FIG. 2, and an A.C. high voltage is applied from a voltage source 6 between these electrode groups. As a result, in the proximity of the surface between the electrodes 11 and 12 are generated electric lines of force 13 which bend in an outwardly convex manner as viewed from the surface of said electrode. When the density of these electric lines of force 13, that is, the electric field intensity on the surface of the surface-shaped silent discharge electrode becomes high with respect to an ionization potential of the gas existing in the proximity, a silent discharge arises between the electrodes 11 and 12. With regard to the mode of generation of this silent discharge, it is generated exactly in the same manner on the surfaces of one electrode $E_1$ and the other electrode $E_2$ opposed thereto, and the voltage applied to the electrode $E_2$ is fed from a voltage source 7 as shown in FIG. 2. These silent discharge electrodes $E_1$ and $E_2$ are disposed in an opposed relationship to each other and separated by a space 20, as illustrated in the same figure.

In FIGS. 3S$_1$, 3S$_2$ and 3R are illustrated waveforms of A.C. voltages to be applied between the respective linear electrodes 11 and 12 in the surface-shaped silent discharge electrodes. More particularly, with reference to FIG. 3S$_1$, it has been well-known in the art of silent discharge that in one period extending from time interval 21 to time interval 24 among the intervals 21 to 26 of time *t*, a silent discharge would occur only in the time intervals 22 and 24. Accordingly, on the electrode $E_1$, in the time intervals 22 and 24, a high frequency silent discharge of several tens Hz to several MHz in frequency would arise between the respective adjacent electrode elements, that is, between the linear electrodes 11 and 12. In this case, the frequency of the voltage applied by the voltage supply 6 is normally of the order of 10 Hz to 1000 Hz. Accordingly, in the time intervals 22 and 24, strong ionization would occur in the proximity of the electric lines of force 13 on the surface of the surface-shaped silent discharge electrode $E_1$, so that in these time intervals, the so-called plasma space in which a great number of electrons and positive and negative ions exist. Therefore, if a D.C. potential difference exists between the electrode $E_1$ and the electrode $E_2$, then either positive or negative monopolar ions are selectively extracted from the plasma space towards the space 20 depending upon the polarity of the potential difference between the electrodes $E_1$ and $E_2$.

Now referring to FIG. 3S$_2$, there is shown a voltage waveform applied between the linear electrodes 11*a* and 12*a* embedded within the electrode $E_2$. More particularly, the A.C. voltage applied between the linear electrodes 11*a* and 12*a* embedded within the electrode $E_2$ has the same waveform as the A.C. voltage applied between the linear electrodes 11 and 12 embedded within the electrode $E_1$, but the phase of the former A.C. voltage is delayed by ¼period with respect to the latter A.C. voltage. In such a case, as will be obvious from FIGS. 3S$_1$ and 3S$_2$, in the time interval 22 in which a silent discharge occurs on the surface of electrode $E_1$, a silent discharge does not exist on the surface of the electrode $E_2$. In the time interval 21 in which a silent discharge does not occur on the surface of the electrode $E_1$, a silent discharge exists on the surface of the electrode $E_2$. A similar relationship is stably established in the subsequent time intervals.

The waveform shown in FIG. 3R represents the potential of electrode $E_1$ with respect to ground potential. The circuit arrangement shown in FIG. 2 is constructed in such manner that a voltage may be applied from a voltage source 8 to the electrode $E_2$ so that the potential of the electrode $E_2$ with respect to the ground potential may be an inversion of the potential applied to the electrode $E_1$. In the time interval 21, between the electrodes $E_1$ and $E_2$ exists an electric field directed from the electrode $E_1$ to the electrode $E_2$, because the electrode $E_1$ has a positive potential with respect to the ground potential while the electrode $E_2$ has a negative potential with respect to ground potential. On the other hand, as will be obvious from FIG. 3S$_2$, in the time interval 21 a plasma generated by a silent discharge exists only on the surface of the electrode $E_2$. Owing to the electric field directed from the electrode $E_1$ to electrode $E_2$, only negative ions are extracted from the surface of the electrode $E_2$ towards the space 20 and then arrive at the elecrrode $E_1$. The ions existing within the space 20 in the time interval 21 are only the negative monopolar ions extracted from the electrode $E_2$.

Subsequently in the time interval 22, a silent discharge does not exist on the surface of the electrode $E_2$ but instead a silent discharge exists only on the surface of the electrode $E_1$, so that in the proximity of the surface of the electrode $E_1$ there exists a plasma consisting of positive and negative ions and electrons. However, in the time interval 22, since the relative potential between the electrodes $E_1$ and $E_2$ has been switched by the voltage supply 8 so that the electrode $E_1$ may have a negative potential with respect to ground potential, while the electrode $E_2$ may have a positive potential with respect to ground potential. In the time interval 22 negative ions are extracted from a plasma existing only on the surface of the electrode $E_1$ towards the space 20, and eventually arrive at the electrode $E_2$. Accordingly, in the time interval 22 ions existing in the space 20 are only the negative ions extracted from the plasma existing on the surface of the electrode $E_1$.

Subsequently, through a similar process monopolar ions are extracted towards the space 20 alternately from the respective electrodes $E_1$ and $E_2$ at every one-fourth cycle of the fundamental frequency of the A.C. voltages applied to the electrodes $E_1$ and $E_2$. Accordingly, the voltage supply 8 for generating a relative potential between the electrodes $E_1$ and $E_2$ is constructed in such manner that said voltage supply 8 has a frequency twice as high as the frequency of the voltage supplies 6 and 7 for generating a plasma on the surfaces of the electrodes $E_1$ and $E_2$, and inversion of the relative potential between the respective electrodes $E_1$ and $E_2$ may not occur during the period when a silent discharge is arising on either one of the electrode surfaces.

As described, in the apparatus for producing charged particles according to the present invention, either positive ions or negative ions only would exist in the space 20 depending upon the selection of the polarity of the relative potential appearing between the electrodes $E_1$ and $E_2$, and the direction of the electric field within the space 20 is alternated at a frequency of 20 Hz or higher. Therefore, if the particles 4 within the hopper 3 are introduced into space 20 in the direction indicated by arrow 5 as shown in FIG. 2, the particles can be fully charged by collision with either electrons or ions existing in the space 20 as selected by the phase of the voltage supply 8. Since the electric field existing within this space is an A.C. electric field, the particles are driven out of this space by a driving force such as a gravity, a wind force, etc. without being attracted towards either one of the electrodes as indicated by arrow 17. Thus it is possible to supply fully charged particles into a predetermined operation region in a reliable manner.

However, since normally a gas exists within the space 20 in addition to the powder particles, when the particles flow through this space there appears a part of the particles which approaches electrodes $E_1$ or $E_2$ owing to the flow of the gas. But, on the surfaces of the electrodes $E_1$ and $E_2$, there always exists outwardly convex alternating electric fields 13. Thus the charged particles existing within the sapce 20 vibrate along these outwardly convex alternating electric fields, so that the charged particles are always subjected to a force for repelling the particles from the surfaces of the electrodes. Therefore, in the apparatus for producing charged particles according to the present invention, there is no fear that particles may be adhered onto the surfaces of the electrodes $E_1$ and $E_2$ due to turburence of a gas flow existing within the space 20. Thus the ion feed capability of the electrodes may be be changed and it becomes possible to operate the apparatus for producing charged particles continously and stably over an extremely long period of time. Still further, in the apparatus for producing charged particles according to the present invention, since the particles charged within space 20 move while being vibrated by the relative potential existing between the electrodes $E_1$ and $E_2$, and since the mass and shape of the particles are normally different from each other, there occurs an agitation effect, resulting in a remarkable improvement in the charging efficiency.

With regard to the method for feeding voltages having a phase relationship as illustrated in FIGS. $3S_1$, $3S_2$ and 3R to the respective portions of the apparatus for producing charged particles according to the present invention, it is possible to construct the electric circuit arbitrarily by combining various electric methods which are known. The circuit arrangement illustrated in FIG. 2 is one of the preferred embodiments, in which to terminals 16 there is applied a sinusoidal A.C. voltage having the conventional commercial frequency of 50 Hz. An A.C. voltage applied between the electrodes 11*a* and 12*a* embedded in the proximity of the surface of the electrode $E_2$ is obtained by directly stepping up this A.C. voltage with a transformer 7.

Means for applying a voltage between the linear electrodes 11 and 12 embedded in the proximity of the surface of the electrode $E_1$, is constructed in such manner that the voltage applied to the terminals 16 is shifted in phase by a ¼ period by means of a phase shifter 15. The phase shifted voltage is then stepped up by a transformer 6 and fed to the electrodes 11 and 12. Means for generating a relative potential difference between the electrodes $E_1$ and $E_2$ is constructed in such manner that the commercial frequency of the A.C. voltage applied to the terminals 16 is converted into a frequency twice as high as the original commercial frequency by means of a frequency converter 10. After the phase of the converted A.C. voltage has been adjusted so that inversion of the relative voltage between the respective electrodes may not occur during the period when silent discharge is arising on either one of the electrode surfaces, the converted voltage is applied between the electrodes $E_1$ and $E_2$ via a transformer 8 and at the junctions 6*a* and 7*a*, respectively to generate the relative potential difference therebetween. In the illustrated embodiment, the secondary of the transformer 8 is grounded at its neutral point 9, and the electric charge stored excessively on the surfaces of the respective electrodes by charging the powder particles is removed through this grounded neutral point 9.

In general, the insulator layers 1 and 2 used for the electrodes $E_1$ and $E_2$ have a thinner layer portion of the front surface side of the electrode, and so the above-referred stored charge can be removed through the thinner insulator layer portion and via the neutral point 9. Possible troubles can be readily overcome by appropriately adjusting the resistance of the insulator layer portion on the front surface side of the electrode. Since the surface potentials of the electrodes may possibly shift to some extent either with respect to a D.C. component or with respect to an A.C. component depending upon the amount of the passing powder, the quantity of electric charge conveyed away by the particle, and storage of electric charge coming from the other electrode, it is sometimes more convenient to make adjustable the phase relationship between the voltages applied to the respective electrodes and the voltage for generating a relative potential between the respective electrodes.

In the apparatus for producing charged particles according to the present invention, since the voltages applied to the respective ones of the opposed surface-shaped silent discharge electrodes could have exactly the same frequency and the voltage applied between the opposed electrodes is adapted to have a fundamental frequency just twice as high as said first frequency, the frequencies and the phase relationship of the respective voltage supplies can be readily defined in a very clear manner, and therefore, it is the characteristic advantage of the present invention that there is no need to carry out a delicate adjustment for operation of the apparatus and stable and reliable operation can be assured over a long period of time.

In some cases, it is convenient for adjusting the timing of the generation of the discharge as well as the intensity of the discharge on the respective discharge electrodes to use a distorted A.C. voltage having an appropriate waveform as the voltage applied to the surface-shaped silent discharge electrodes. Also an appropriate waveform such as a rectangular waveform provided with a pause in its intermediate portion depending upon the timing of generation of a silent discharge, can be employed besides the simple rectangular waveform illustrated in FIG. 3R. Reference numeral 14 in FIG. 2 designates a bias voltage source adapted to generate a D.C. or A.C. voltage, which can be conveniently utilized in case that a potential difference exists between the subject apparatus and the utilization apparatus to which the charged particles are to be fed.

As the surface-shaped silent discharge electrode to be used in the apparatus for producing charged particles, besides the structures shown in FIGS. 1 and 2, electrode structures as shown in FIGS. 4, 5, 6, 7, 8 and 9 can be equally employed. In the structure shown in FIG. 7, in the shallow portion near to the front surface of the insulator layer 1 are embedded a plurality of parallel linear electrodes 11 at equal intervals. In the deep portion there is provided a surface-shaped electrode 12*b* embedded at an equal distance from said parallel linear electrodes. Between the linear electrodes 11 and the surface-shaped electrode 12*b* is connected a voltage supply 6 as shown in this figure.

In the structure shown in FIG. 4, the surface-shaped silent discharge electrode is constructed in such manner that a plurality of linear electrodes 11 each of which is coated with an insulator 1*a* are disposed in parallel to each other on a surface of a surface-shaped electrode 12*c*. Between the linear electrodes 11 and the surface-shaped electrode 12*c* is connected an A.C. power supply 6 to generate a silent discharge between the electrodes 11 and 12*c*. It is also possible to construct the surface-shaped silent discharge electrode in such manner that linear electrodes 11 and 12 each of which is coated with an insulator are disposed in parallel to each other so as to align on an imaginary plane without providing a specific support insulator layer. Between these electrodes 11 and 12 is applied an alternating voltage from a voltage supply 6 as shown in FIG. 5.

FIG. 6 shows a modified embodiment in which in order to remove stored electric charge more reliably base electrodes are used as the electrodes 12 and only the electrodes 11 are coated with an insulator 1a. The embodiments shown in FIGS. 5 and 6 are conveniently used where it is required to feed ions towards the opposite sides of the electrode surface. Also such type of electrodes can be used and mounted in multiple and in parallel to each other inside of a separate vessel.

As described in detail above, various modifications can be made in the structure of the surface-shaped silent discharge generating electrode according to the present invention. The expression that the opposed electrodes are in parallel to each other, is intended to include not only the structure in which the electrodes are in parallel to each other on the same plane, but also the structure as shown in FIGS. 8 and 9 in which the electrodes are located on two parallel planes and also disposed in parallel to each other on each plane. In addition, the same expression, of course, includes the structure in which electrodes 11 and 12 are disposed on concentric circles. The expression of "parallel" covers parallel curved linear electrodes, too. Also, the configuration of the opposed surface-shaped silent discharge electrodes need not be a plane, but one electrode could be constructed as a cylindrical electrode $E_{1a}$ and the other electrode $E_{2a}$ could be composed of electrodes formed on a concentric cylinder as opposed to the former electrode, as shown in FIG. 10. It is a matter of course that particles can be fed into the intermediate space between these opposed cylindrical electrodes in a troidal shape as shown by arrow 5*a* by means of a rotary disc device 3*a* or the like as shown in FIG. 10. In such cases, in order to feed the sufficiently charged particles to a desired location, of course, various electric field devices such as shown at 30 in FIG. 10 can be used.

Still further, the two cylindrical electrodes illustrated in FIG. 10 could be modified into two conformed conical electrodes disposed in a coaxial relationship.

Now one preferred embodiment of the present invention will be described in further detail. The electrode $E_1$ is constructed by embedding linear electrodes 11 and 12 having a diameter of 0.2 mm with a pitch of 3 mm at a depth of 0.5 mm as measured from the surface of a glass plate having a specific resistivity of the order of $10^{11}$ Ω cm by connecting every other one of these electrodes in common. The voltage applied between these linear electrodes is selected at 3500 V, while the frequency of the same voltage is chosen at 50 Hz. In this example, the thickness of the entire glass layer 1 is equal to 3 mm. An electrode $E_2$ having exactly the same structure as that described above is disposed in opposition to the electrode $E_1$ leaving an interval of 50 mm therebetween. The voltage applied from the voltage supply 7 to the electrode $E_2$ is chosen exactly the same as the voltage applied from the voltage supply 6 to the electrode $E_1$. The voltages applied to the voltage supply 6 and the voltage supply 7 are shifted in phase by a ¼ period. Between the electrodes $E_1$ and $E_2$ there is applied a rectangular wave of 100 Hz in frequency as shown in FIG. 3R by means of a switching device employing a thyristor to generate a relative potential difference of 5000 V between the electrodes $E_1$ and $E_2$. In this way, when powder is dispersed and fed into the space 20 at a rate of 200 g per minute. If the passage distance of the powder is selected at 30 cm, the powder is charged monopolarly, the average charge quantity amounts to 82% of the theoretically saturated charge quantity, an average charge quantity of $0.98 \times 10^{-14}$ Coulomb can be obtained with particles having an average particle diameter of 26 microns, and it is possible to carry out a perfectly continuous automatic operation over a period of 500 hours or more.

What is claimed is:

1. An apparatus for producing charged particles, comprising a pair of surface-shaped ion generating electrodes, in each of which every other one of parallel linear electrodes spaced apart at a predetermined interval are connected in common to form separate electrode groups, said parallel linear electrodes, of at least one said electrode group being coated with an insulator, and an alternating voltage is applied between said respective electrode groups, and an alternating voltage is applied between said respective electrodes; a charging space formed between said pair of ion generating electrodes spaced in opposition to each other; means for shifting the phases of the alternating voltages applied to the respective ion generating electrodes relative to each other; and voltage supply means for applying between said respective ion generating electrodes another alternating voltage having a fundamental frequency twice as high as the frequency of the alternating voltage applied to the respective ion generating electrodes in such phase relationship to said latter alternating voltage that inversion of the relative voltage between said respective electrode surfaces may not occur during the period when silent discharge is arising on one of the electrode surfaces.

2. An apparatus for producing charged particles, in which there are provided a pair of surface-shaped silent discharge electrodes with a space interposed therebetween and a high voltage is applied across said pair of surface-shaped silent discharge electrodes, comprising:

a. a plurality of electrodes arrayed in parallel to each other and insulated from each other to form each said surface-shaped silent discharged electrode, b. an A.C. voltage supply for establishing an uneven alternating electric field between adjacent electrodes among said plurality of electrodes, c. means for shifting the relative phase between the A.C. voltage supply for one of said surface-shaped silent discharge electrodes and the other A.C. voltage supply for the other of said surface-shaped silent discharge electrodes, provided between said A.C. voltage supplies, and d. means for applying a high voltage between said plurality of electrodes forming one of said surface-shaped silent discharge electrodes and said plurality of electrodes forming the other of said surface shaped silent discharge electrodes, the frequency of said high voltage being twice as high as the frequency of the A.C. voltage supply for etablishing an uneven alternating electric field between said adjacent electrodes.

3. An apparatus for producing charged particles as claimed in claim 2, in which each said surface-shaped silent discharge electrode consists of a plurality of linear electrodes arrayed in parallel to each other.

4. An apparatus for producing charged particles as claimed in claim 2, in which said plurality of electrodes are embedded within a single planar insulator layer.

5. An apparatus for producing charged particles as claimed in claim 2, in which among said plurality of electrodes only one of the electrodes adjacent to each other is coated by an insulator.

6. An apparatus for producing charged particles as claimed in claim 2, in which each said surface-shaped silent discharge electrode comprises a single planar electrode and a grid-like electrode consisting of a plurality linear electrodes arrayed in parallel to each other, said planar electrode and said grid-like electrode being positioned as opposed to each other.

7. An apparatus for producing charged particles as claimed in claim 2, characterized in that each said surface-shaped silent discharge electrode consists of a plurality of linear electrodes arrayed in parallel to each other along an outer plane surface of a single insulator layer and also along an inner plane surface of said insulator layer itself.

8. An apparatus for producing charged particles as claimed in claim 2, characterized in that each said surface-shaped silent discharge electrode consists of a plurality of parallel linear electrodes arrayed along each of two plane surfaces disposed in parallel to each other within a single planar insulator layer itself.

9. An apparatus for producing charged particles as claimed in claim 2, characterized in that said pair of surface-shaped silent discharge electrodes are formed in two cylindrical shapes disposed in a concentric relationship.

10. An apparatus for producing charged particles as claimed in claim 2, characterized in that said pair of surface-shaped silent discharge electrodes are formed in two conical shapes disposed in a concentric relationship.

11. An apparatus for producing charged particles, comprising a pair of surface-shaped ion generating electrodes in each of which there are provided a grid electrode consisting of parallel linear electrodes spaced apart at a predetermined interval and a surface-shaped electrode spaced apart from said grid electrode at a substantially fixed distance and insulated by an insulator, and an alternating voltage is applied between said respective electrodes; a charging space formed between said pair of ion generating electrodes spaced in opposition to each other; means for shifting the phases of the alternating voltages applied to the respective ion generating electrodes relative to each other; and voltage supply means for applying between said respective ion generating electrodes another alternating voltage having a fundamental frequency twice as high as the frequency of the alternating voltage applied to the respective ion generating electrodes in such phase relationship to said latter alternating voltage that inversion of the relative voltage between said respective electrode surfaces may not occur during the period when silent discharge is arising on one of the electrode surfaces.

* * * * *

UNITED STATES PATENT AND TRADEMARK OFFICE

CERTIFICATE OF CORRECTION

PATENT NO. : 4,029,995

DATED : June 14, 1977

INVENTOR(S) : Tsutomu Itoh

It is certified that error appears in the above-identified patent and that said Letters Patent are hereby corrected as shown below:

Column 1, line 18:
"of" should be ---or---

Column 2, line 66:
"logitudinal" should be ---longitudinal---

Column 4, line 25:
"elecrrode" should be ---electrode---

Column 5, line 20:
"sapce" should be ---space---

Column 5, line 27:
"turburence" should be ---turbulence---

Column 5, line 29:
"be changed" should be ---changed---

Column 6, line 14:
"of" should be ---on---

Signed and Sealed this

*Twenty-ninth* Day of *November 1977*

[SEAL]

*Attest:*

RUTH C. MASON
*Attesting Officer*

LUTRELLE F. PARKER
*Acting Commissioner of Patents and Trademarks*